US008579274B2

(12) United States Patent
Mueller

(10) Patent No.: US 8,579,274 B2
(45) Date of Patent: Nov. 12, 2013

(54) COVER FEEDER FOR MULTIPLE FORMAT COVERS

(75) Inventor: Hans Mueller, Lauda-Koenigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 154 days.

(21) Appl. No.: 13/101,647

(22) Filed: May 5, 2011

(65) Prior Publication Data

US 2011/0280690 A1 Nov. 17, 2011

(30) Foreign Application Priority Data

May 12, 2010 (CH) ..... 0760/10

(51) Int. Cl.
*B65H 1/30* (2006.01)

(52) U.S. Cl.
USPC ..... 270/52.2; 271/151; 271/238

(58) Field of Classification Search
USPC ..... 270/52.02, 52.2; 271/234, 237, 238, 271/150, 151
See application file for complete search history.

(56) References Cited

U.S. PATENT DOCUMENTS

| | | | | |
|---|---|---|---|---|
| 2,133,726 | A * | 10/1938 | Staude | 271/38 |
| 3,904,191 | A * | 9/1975 | Maier et al. | 271/150 |
| 4,049,260 | A * | 9/1977 | Szymborski | 271/151 |
| 4,637,602 | A * | 1/1987 | Gavaghan et al. | 271/238 |
| 5,013,022 | A * | 5/1991 | Graushar | 270/56 |
| 6,192,295 | B1 * | 2/2001 | Gunther | 700/225 |
| 6,829,521 | B2 * | 12/2004 | Graushar et al. | 700/225 |
| 7,272,466 | B2 * | 9/2007 | Graushar et al. | 700/227 |
| 2003/0015835 | A1 * | 1/2003 | Post et al. | 271/149 |
| 2012/0025442 | A1 * | 2/2012 | Naraoka | 270/58.12 |

FOREIGN PATENT DOCUMENTS

| | | | |
|---|---|---|---|
| DE | 3614216 | A1 | 10/1987 |
| DE | 9403531 | U1 | 11/1994 |
| DE | 19931742 | A1 | 1/2001 |
| DE | 20202513UF | | 6/2002 |
| EP | 1780037 | A1 | 10/2005 |
| EP | 1840062 | A1 | 10/2007 |
| GB | 2132174 | A | 7/1984 |

OTHER PUBLICATIONS

International Search Report of CH7602010 Dated August 30, 2010.

* cited by examiner

*Primary Examiner* — Patrick Mackey
(74) *Attorney, Agent, or Firm* — Venable LLP; Robert Kinberg

(57) ABSTRACT

A book cover feeder to supply book covers to a production unit of a book production line. The feeder has a guiding side and a driving side for conveying the book covers in a production direction. The book cover feeder comprising includes a feeding device onto which book covers of a single format are deposited singly, in a scaled formation or in a stack formation. A magazine is arranged to receive the covers from the feeding device. The magazine has a stacking shaft. A separating device is operatively arranged relative to the magazine. The feeding device, the cover magazine and the separating device are embodied integrally or adjoining each other. The feeding device includes, on the guiding side and/or the driving side, a side guiding device that is divided into multiple sections arranged one behind the other in the production direction.

17 Claims, 10 Drawing Sheets

COVER FEEDER FOR MULTIPLE FORMAT COVERS

CROSS-REFERENCE TO RELATED APPLICATION

This application claims the priority of Swiss Patent Application with No. 00760/10, filed on May 12, 2010, the subject matter of which is incorporated herein by reference.

BACKGROUND OF THE INVENTION

The invention relates to a feeder for supplying book covers to a production unit in a book production line, to a method for feeding a stack of book covers on such a book cover feeder, and to a book production line which comprises such a book cover feeder.

Known book production lines in a clocked operation join respectively one book block and one book cover to form a book. In a general sense, the book cover is the part of the book which is fitted around a book block, to protect the book block, independent of the construction of the cover band or the band with fitted-on covers.

The so-called covering as a rule consists of two rigid cover sections of cardboard which are held together by a binding material. A so-called center strip is attached on each side as a back insert to the binding material. The covering material for the most part consists of paper, but can also consist of other materials such as fabric or leather. Between these three sections, meaning the two cover sections and the center binding strip, a type of hinge is formed for the finished book.

The book blocks and the book covers are normally first produced in separate machines. In known book production lines, the book block at the beginning moves separately from the book cover through processing stations, such as stations for rounding, compressing, applying glue to the back, applying headbands, and the like. The so-called marriage of book block and book cover subsequently takes place in the casing-in machine, wherein the casing-in machine is understood to be a production unit in the book production line.

A book cover feeder is disclosed in German patent document DE 94 03 531 U1 which feeds book covers to casing-in machines. The substantially horizontally positioned book covers are stacked inside a book cover magazine so that a respectively lowest book cover in the stack just comes in contact with the operational surface of conveying belts. With a clocked operation, a belt conveyor of this type will pull the respectively lowest book cover from the stack and transport it through a gap and out of the book cover magazine. When processing hard covers, this known book cover magazine can be operated with an additionally integrated sliding support.

Additional book cover magazines are disclosed in German patent documents DE 36 14 216 C2 and DE 202 02 513 U1.

Known book cover magazines represent extensions of respective magazine shafts. The storage of book covers to be processed is increased when using such a book cover magazine. The book covers are preferably deposited in a scaled formation onto the book cover magazine. For the correct positioning of the book covers, the magazine is provided with guiding devices in the front, at the rear and on the right and left sides. The delimiting parts of a book cover belt, which are arranged on the side, orient the book covers centrally, relative to the back inlay. For this, a guiding device in the magazine shaft, on the back right side, is mechanically connected to rear guiding device of the cover belt magazine. This side guiding device and/or the side end stop for the cover are adjusted jointly with the aid of an adjustment motor. A level control in the magazine shaft controls the drive motor for the feeder belt and ensures an automatic filling of the magazine shaft with book covers.

Once it arrives at the casing-in machine, the book block, which rests straddling on a saddle plate, is guided vertically past a side glue applicator, for example as disclosed in European patent document EP 1 780 037. In the process, glue is applied to two fly leaves of the book block. Via feeding rails and with the aid of a pusher, the book cover is supplied horizontally above the side glue applicator and is positioned above the arriving book block. Following this, a pressing on device, for example as disclosed in European patent document EP 1 780 038, takes over the book cover and combines it so as to be precisely fitting with the book block.

Known book production lines are assumed to process medium to large book editions. Consequently, for a series consisting of several book blocks, just as many book covers are made available. The sequence is therefore not important since one book is joined in the same way as another book within the same edition.

When producing personal books such as photo albums, the book block and the book cover are unique items. In general, when producing personal books or small or micro-editions, an unambiguous identification of the book cover and the book block is a decisive criterion. To ensure a non-problematic processing in the machine, either the book cover or the book block must take on a control function. As a result, one part predetermines for the book production line which part must be joined to it.

SUMMARY OF THE INVENTION

One object of the invention therefore is to make possible a targeted and flexible incorporation of one of the parts of the book of a small or micro-edition into a book production line to achieve an economic and secure allocation, if possible, of the parts to be combined.

Another object is to feed a book cover feeder of the aforementioned generic type which simultaneously stores several cover formats, so as to allow a sequential and economic processing of the book covers with different formats, wherein the change to the different formats should be automatic, if possible.

The above and other objects are accomplished according to the invention, wherein there is provided, in one embodiment, a book cover feeder to supply book covers to a production unit of a book production line, the feeder having a guiding side and a driving side for conveying the book covers in a production direction, the book cover feeder comprising: a feeding device onto which book covers of a single format are deposited singly, in a scaled formation or in a stack formation; a magazine arranged to receive the covers from the feeding device, the magazine having a stacking shaft; and a separating device operatively arranged relative to the magazine; wherein the feeding device, the cover magazine and the separating device are embodied integrally or adjoining each other; and wherein the feeding device includes, on at least one of the guiding side and the driving side, a side guiding device that is divided into multiple sections arranged one behind the other in the production direction.

The book cover feeder may be integrated into a book production line, wherein the book production line has a guiding side and a driving side along the flow of book covers. The book covers can be conveyed in the form of a book cover flow in a production direction through the book cover feeder. The book cover feeder comprises a feeding device, a cover magazine and a separating device, wherein n book covers can be placed either separately, in a scaled formation and/or as a stack onto the feeding device.

The book covers in a stack are book covers having the same format. The book cover magazine comprises a stacking shaft in which the book covers arriving in a scaled flow can be collected prior to the separation. Based on the known principle, the separating device separates out respectively the lowest book cover from the stack during each separating step and simultaneously conveys this cover away in production direction, wherein basically all known separating principles can be used. The feeding device, the cover magazine and the separating device may be embodied integrally or adjoining each other.

Depending on the design, it is possible to realize compact structures as well as configurations with further storage options for individual book covers or complete stacks.

On the guiding side and/or the driving side, the feeding device is provided with a side guiding device that is divided into many sections, wherein these sections are arranged successively in the production direction.

A cover feeder of this type allows adapting the feeding device in dependence on the format of the stack which is fitted against one of the sections, wherein the cover feeder can be operated automatically.

According to another embodiment of the book cover feeder, at least one first section of the side guiding device, as seen in production direction, may be displaceable transverse to the production direction. If the feeding device is designed to be correspondingly long, then several sections which are embodied so as to be displaceable transverse to the production direction can hold several captured stacks.

An automatic operation in this case means that the stack automatically predetermines a displacement of the section which corresponds to its format.

Sections in the back of additional embodiments, as seen in the production direction, can be moved with pneumatic force toward the back.

Since the aligned book covers are supplied at a very slow speed, a displacement of the book covers on the side in prevented.

When processing large editions, sections that have moved out are again pulled back, so that the sections form a closed plane. This is necessary since the total belt length is utilized for depositing book covers of a single format because of a one-man operation and a high processing speed.

According to a different embodiment of the book cover feeder, at least one last segment of the side guiding device, as seen in the production direction, can be displaced transverse to the production direction, jointly with a corresponding side guiding element of the stacking shaft. With a book cover feeder embodied in this way, the sections and the side guiding elements of a different embodiment are mechanically connected via a longitudinal base. Book cover feeders of this type must be designed especially cost-effective and space-saving.

A different embodiment of the book cover feeder provides that one or several of the sections can respectively be displaced transverse to the production direction, counter to the longitudinal base, with the aid of a rotating spindle that is positioned in the longitudinal base. The spindle can be driven via a drive and a spindle mechanism.

According to another embodiment of the book cover feeder, one or several of the sections can be displaced transverse to the production direction with the aid of a lifting cylinder.

The spindle and the lifting cylinder of another embodiment of the book cover feeder may be connected in series.

With a book cover feeder according to one of the above embodiments, wherein at least one section may be displaced transverse to the production direction, such section may be oriented parallel to the production direction and can be displaced transverse to the production direction with the aid of guide elements, especially paired telescopic guide, while maintaining the parallel alignment to the production direction.

For another embodiment, the feeding of the covers can be designed individually by using individual belts with respectively separate drives. Adjustment devices and guiding devices for the sections of other embodiments May be mounted stationary.

A book cover feeder according to yet another embodiment may include at least one sensor for detecting and reading an identifier on an optional book cover or on the stack. A first sensor of this type may be arranged at the end of the feeding device facing away from the stacking shaft, as seen in the production direction.

With a book cover feeder for yet another embodiment, a signal transmitter may be arranged downstream of the feeding device or at the end of the feeding device that faces the stacking shaft in the production direction. The signal generator may be suitable for detecting a gap between two deposited book covers.

According to another aspect of the invention there is provided a method for creating a stack of book covers on a book cover feeder, comprising the steps of: identifying and reading an identifier on a detected stack; calling up cover information relating to the detected stack; aligning a first guiding section of the cover feeder in dependence on a format information obtained through the identifier; depositing the detected stack of book covers onto the feeding device, against the first guiding section; and conveying the first stack in the production direction.

According to one embodiment of the method, the method steps may follow each other in the above recited sequence.

According to a different embodiment of the method, the method step sequence may be repeated. Several detected stacks may be deposited sequence by sequence on the feeding device, thus resulting in a sequential, format-dependent alignment of the first section.

According to yet another advantageous embodiment of the method, the first section may be displaced for the alignment with the aid of a lifting cylinder and/or a spindle to a desired position.

According to yet a further aspect of the invention, a book production line may be provided with one of the above-described book cover feeders.

BRIEF DESCRIPTION OF THE DRAWINGS

These and other features and advantages of the invention will be further understood from the following detailed description of embodiments with reference to the accompanying drawings, which show in:

FIG. 6B—a different axial section A-A through the side guiding device of the book cover feeder shown in FIG. 2, in the direction transverse to the flow direction, with maximally screwed out spindle and maximally pulled back lifting cylinder.

DETAILED DESCRIPTION

Figure 7:
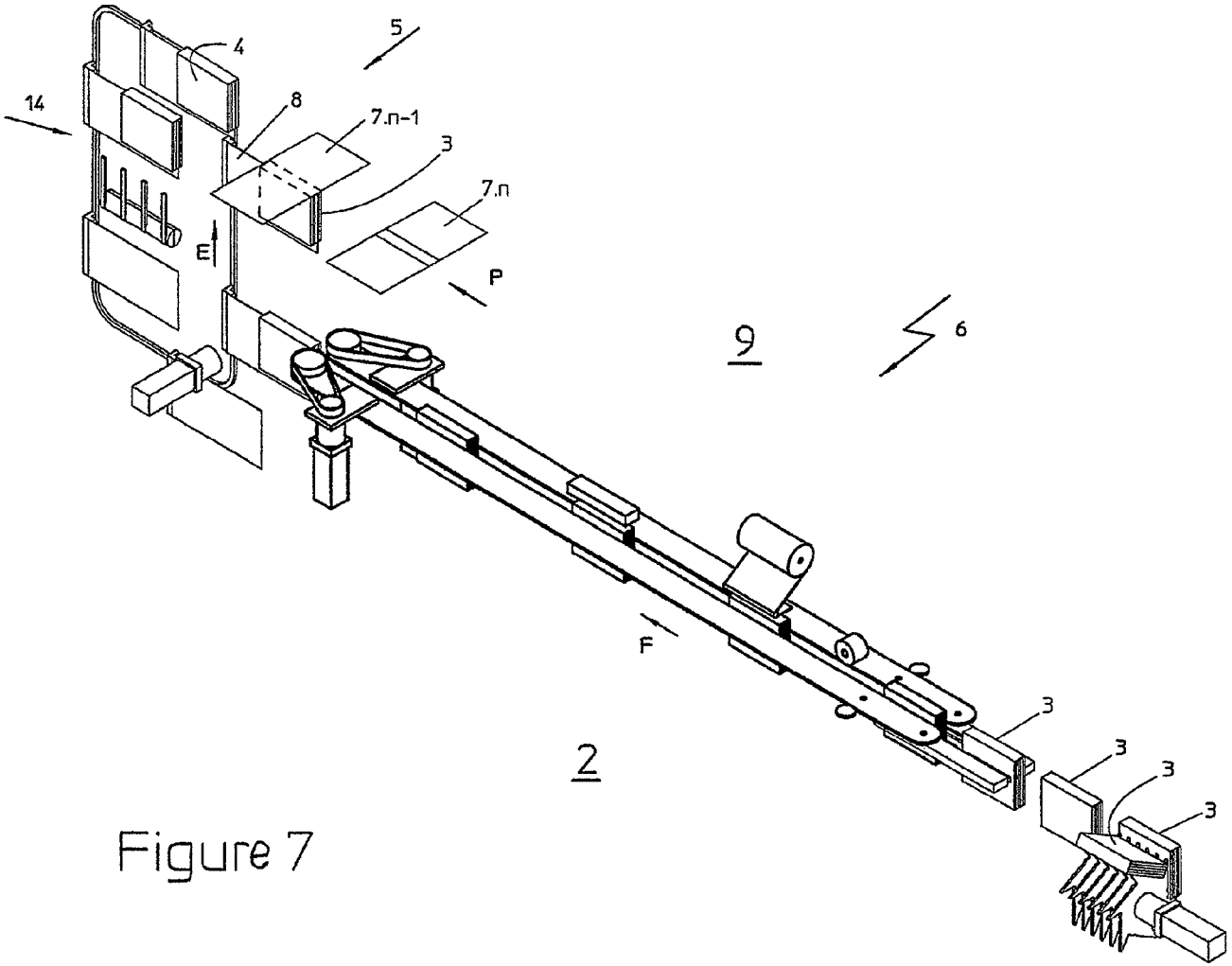
FIG. 7—a perspective view of a schematically shown detail of a known book production line.

FIGS. 1 to 4 show a book cover feeder 1 for feeding n book covers 7.1-7.*n* to a production unit 5 that is part of a book production line 6, as shown in FIG. 7. Book cover feeder 1 is provided with a guiding side 2 and a driving side 9. Drives are normally arranged on the driving side 9 while the guiding side 2 is handled by a machine operator. The book covers 7.1-7.*n* can be conveyed in a production direction P through the book production line 6 and the book cover feeder 1. The last production unit in the book production line 6, shown in FIG. 7, is a casing-in machine.

The book production line 6 initially conveys book blocks 3 without book covers in a conveying direction F through several production units. Each of the production units 5 may contain 4 book blocks 3 without book covers or book blocks 4 with book covers 7.1-7.*n*. Parallel to the conveying direction F, the book covers 7.1-7.*n* are supplied in the production direction P. The casing-in machine comprises a continuous conveyor 14 with saddle plates 8 for transporting the book blocks 3, 4. The saddle plates 8 convey the book blocks 3, which are not yet provided with a book cover 7.1-7.*n*, in a direction E for joining them, meaning to a region below a book cover 7.*n*-1, 7.*n* that has just arrived. Through further movement of the continuous conveyor 14, the respective saddle plate 8 moves below a currently supplied book cover 7.*n*-1, in the direction of the joining location, and the book block 3 resting on this saddle plate 8 lifts up the supplied book cover 7.*n*-1. A pressing on device that is not shown herein takes over the book cover 7.*n*-1 and joins it precisely fitting to the book block 3, so that a book block 4 with cover is created.

The book cover feeder 1 according to FIGS. 1 to 4 is provided in production direction P with a feeding device 10, a cover magazine 20 and a separating device which follow successively, respectively transfer the book covers 7.1 to 7.*n* from one to the other. The book covers 7.1-7.*n* are deposited on the feeding device 10 in a scaled formation, in separate stacks 7 that conform to different orders DS1 to DS7.

Figure 1:
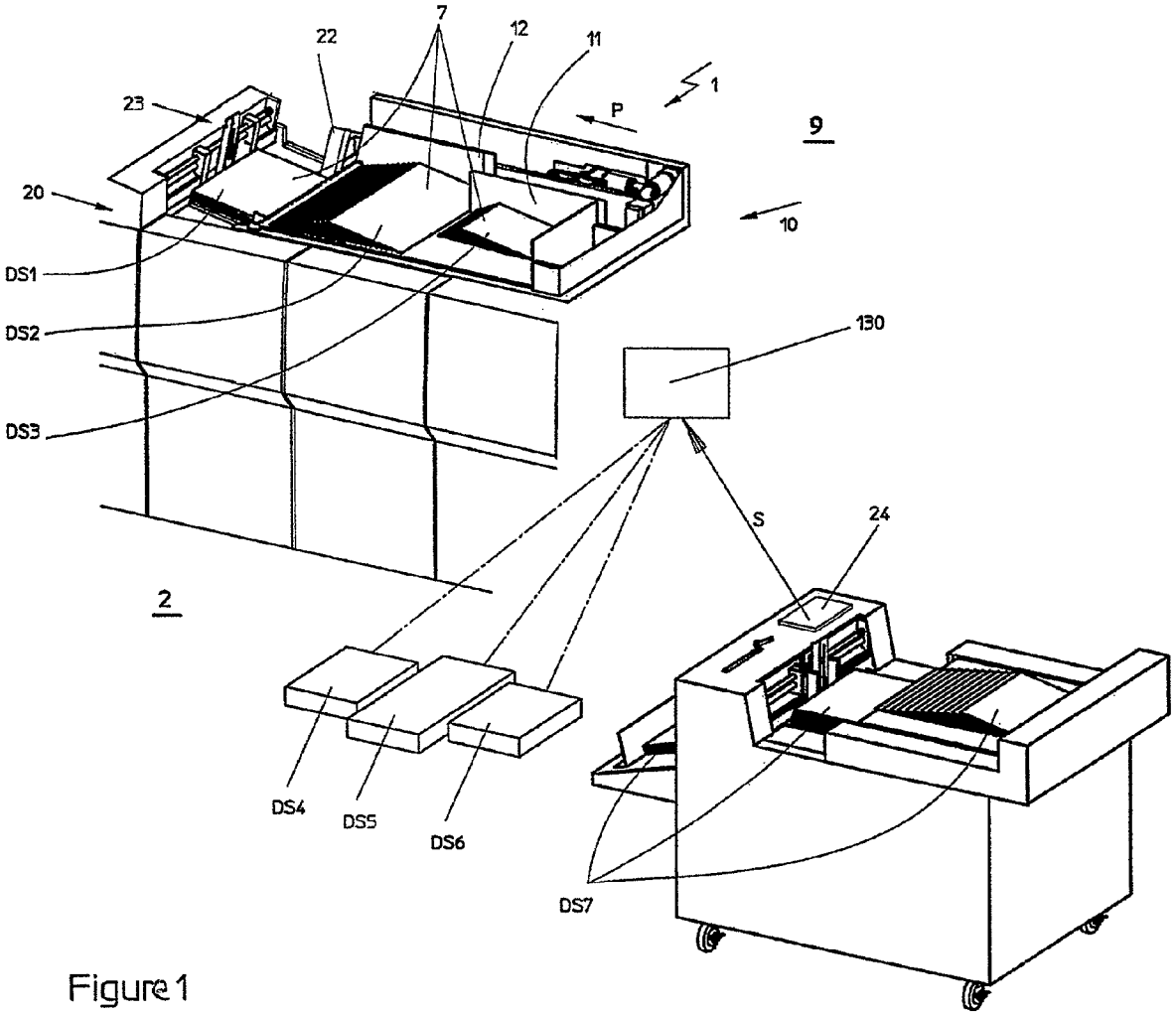
FIG. 1—a basic diagram for illustrating a transfer of book covers to a book cover feeder in a book production line, wherein the book covers are made available outside of the book production line.
Figure 2:
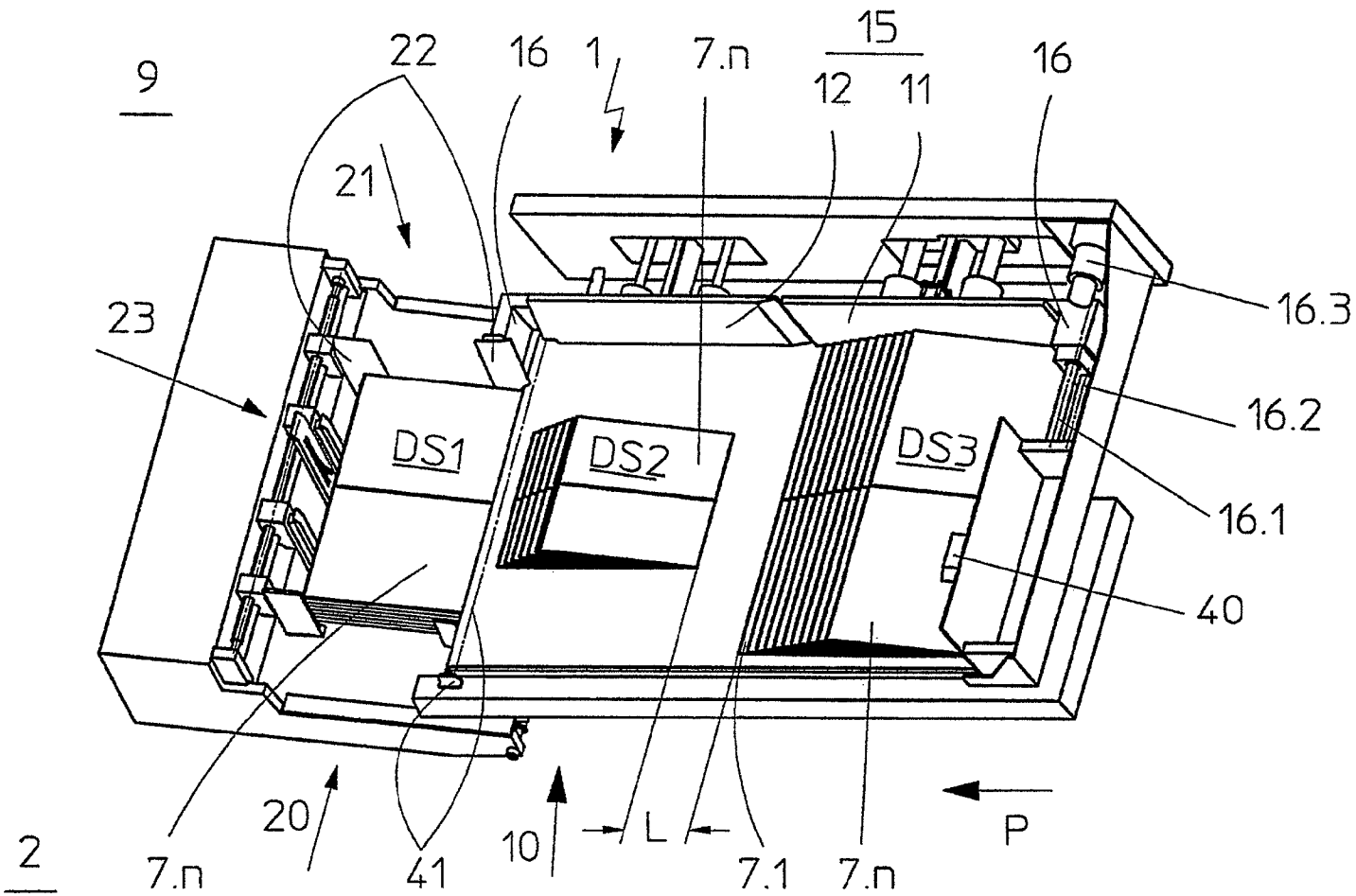
FIG. 2—a perspective representation of the book cover feeder shown in FIG. 1, wherein following the deposit of small-format book covers, the book cover feeder is provided with large-format book covers.
Figure 3:
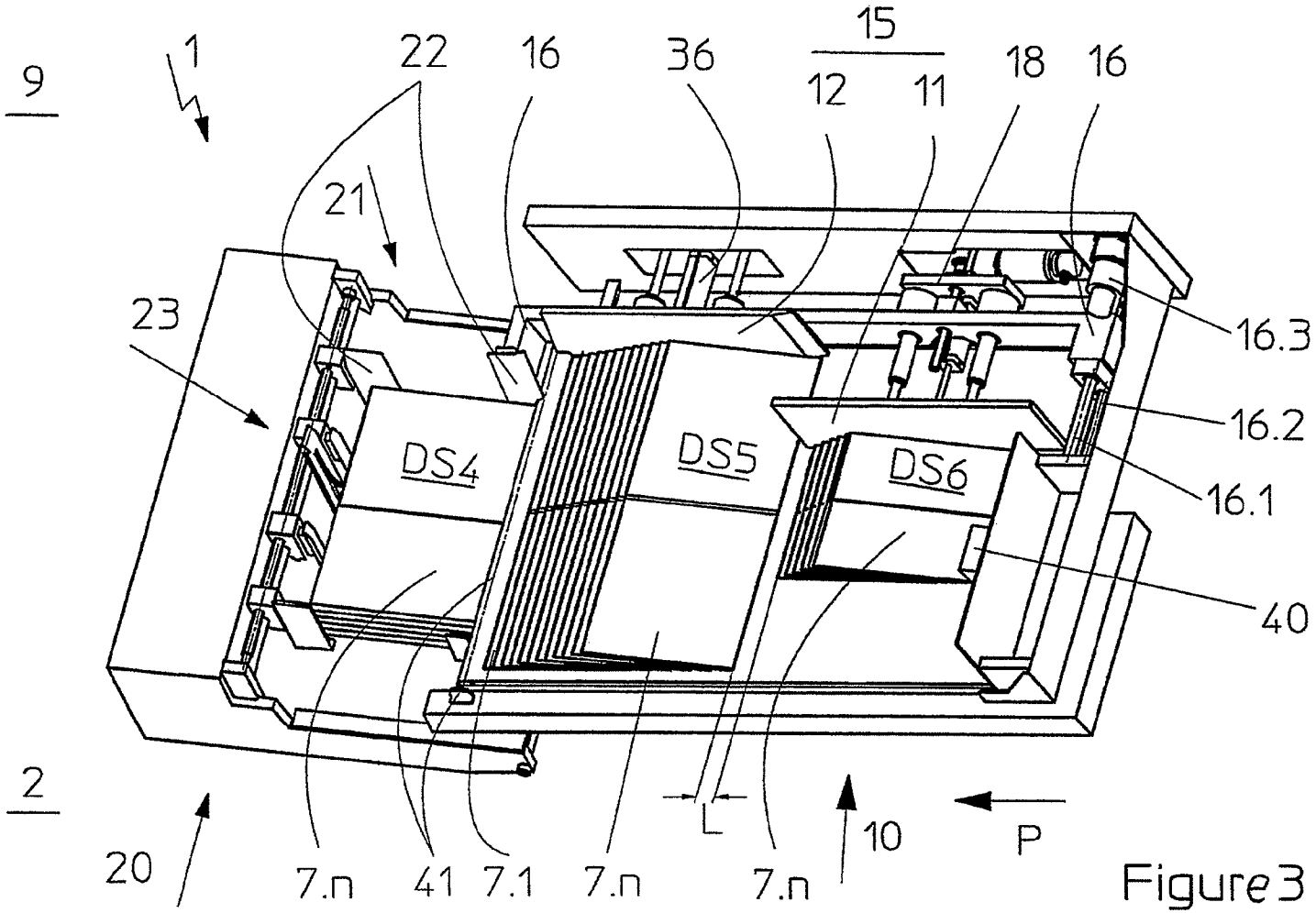
FIG. 3—a perspective representation of the book cover feeder shown in FIG. 1, wherein following the deposit of large-format book covers, the book cover feeder is provided with small-format book covers and wherein for guiding those covers with the aid of a side guiding device, a first section of the side guiding device is moved inward, transverse to the production direction.
Figure 4:
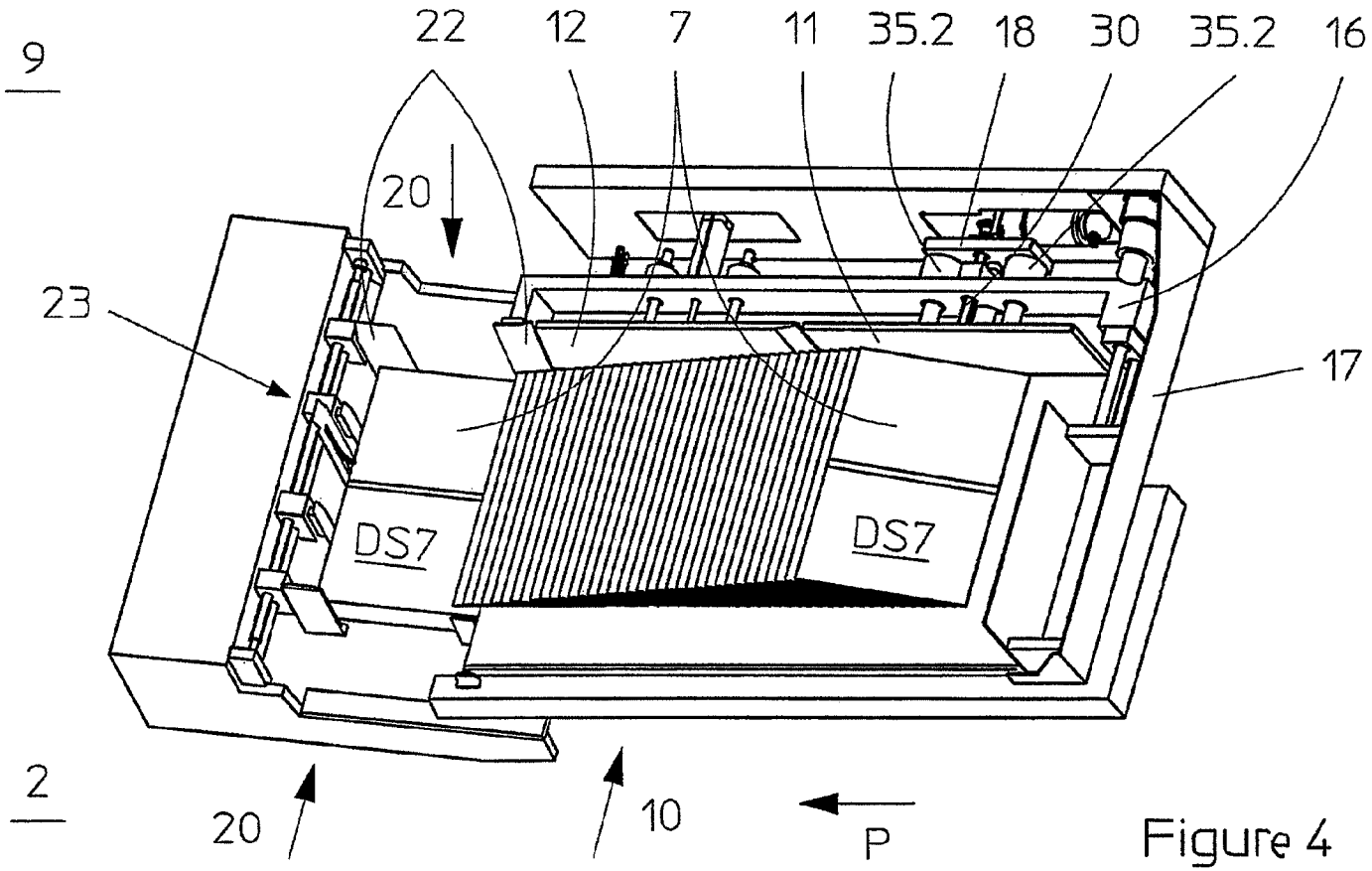
FIG. 4—a perspective representation of the book cover feeder shown in FIG. 1, wherein this feeder is provided with large-format book covers for a large edition.
Figure 5A:
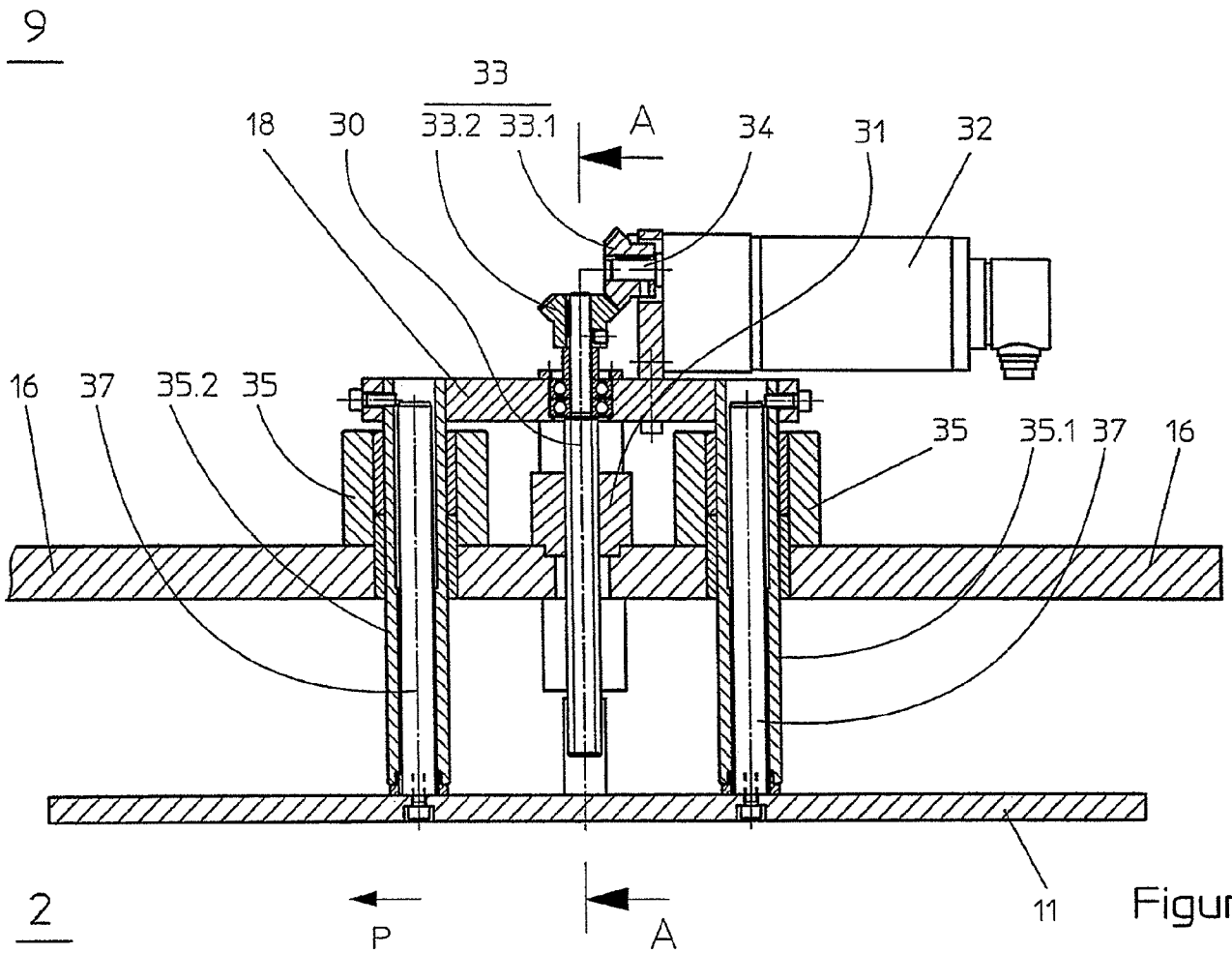
FIG. 5A—an axial section through a plane, spanned by the production direction and the spindle axis, which plane extends through a side guiding device according to a first embodiment of the book cover feeder shown in FIGS. 1 to 4, comprising a driven spindle and a lifting cylinder for adjusting the first section transverse to the production direction.
Figure 5B:
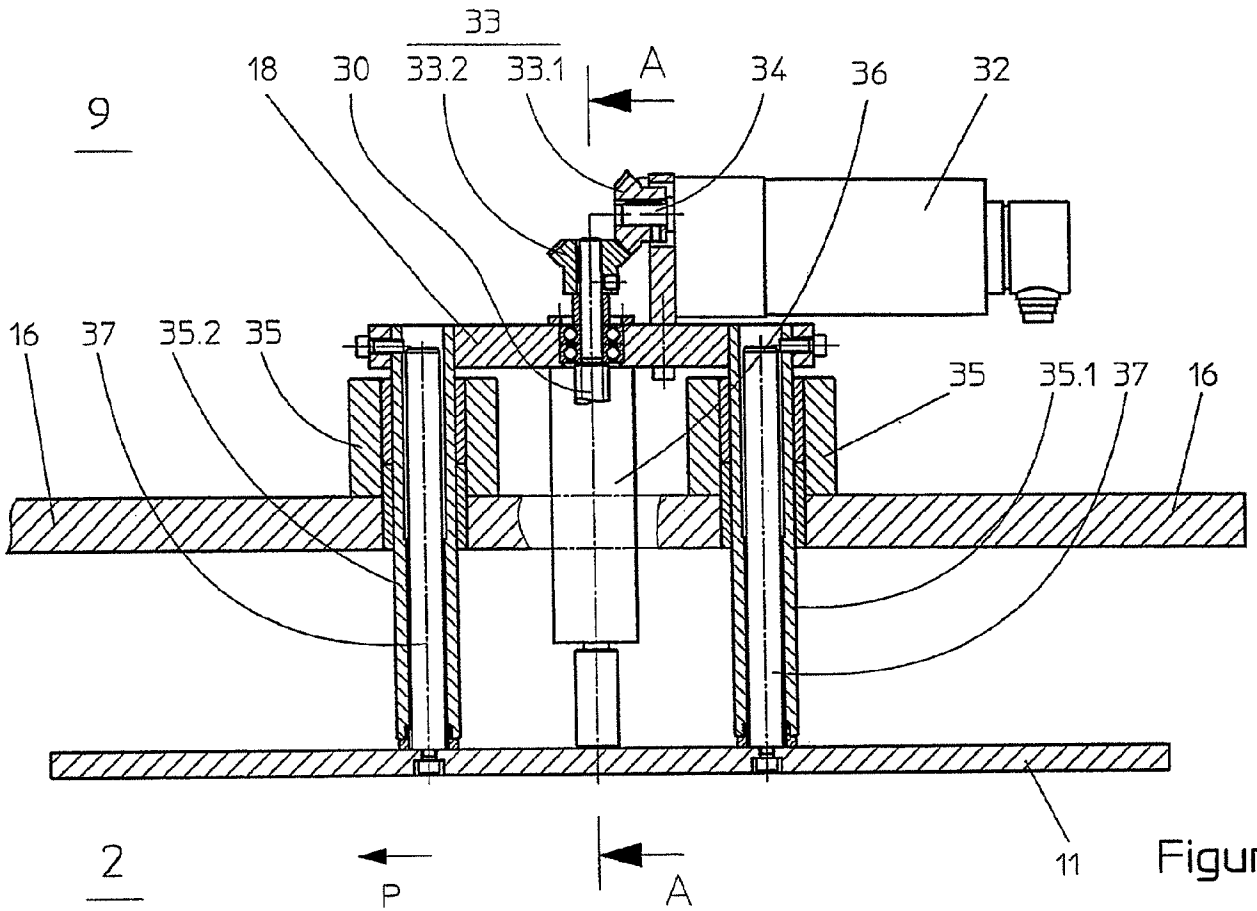
FIG. 5B—an axial section through a side guiding device, shown in FIG. 5A, provided with an opening in the spindle so that the lifting cylinder positioned below can be seen better.
Figure 5C:
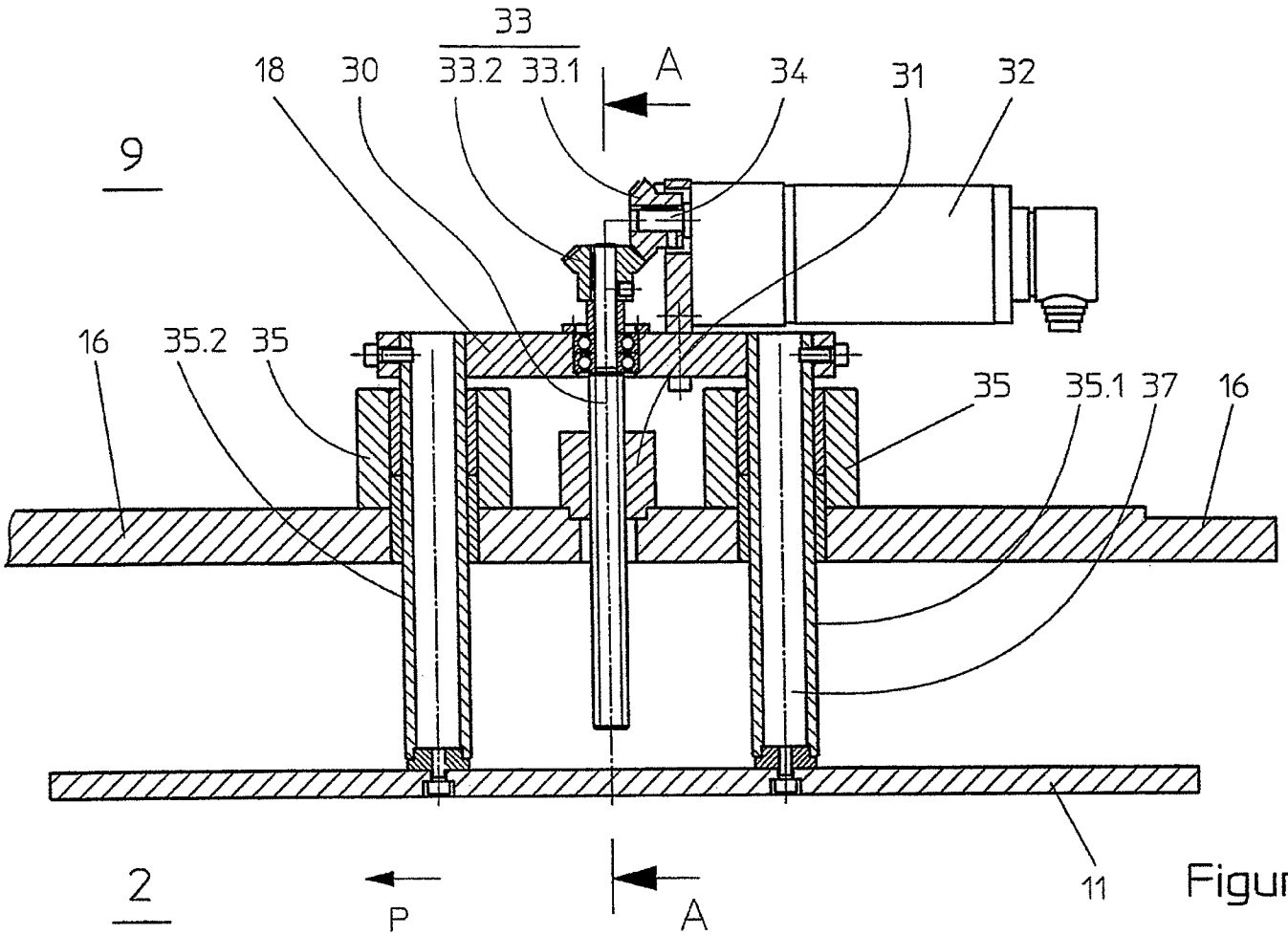
FIG. 5C—an axial section through the plane spanned by the production direction and the spindle axis, which plane extends through a side guiding device, in accordance with a second embodiment of the book cover feeder, using exclusively one driven spindle for adjusting the first section in a direction transverse to the production direction and without lifting cylinder.

In FIGS. 1 to 3, three orders DS1 to DS3 and/or DS4 to DS6 are positioned on the respectively shown book cover feeder 1. The formats for the book covers 7.1-7.*n* are the same for each order DS1 to DS6. These types of orders are understood to be small editions. In the extreme case, a stack 7 only consists of a single book cover 7.1, in which case it would be called a micro-edition.

The cover magazine 20 comprises a stacking shaft with side guiding elements 22, as well as a separating device 23 that is arranged downstream of and/or below the stacking shaft 21. The separating device 23 ensures the removal of respectively the lowest book cover 7.1-7.*n* from the detected stack 7.

The stack 7, which consists of book covers 7.1 to 7.*n*, is called a detected stack 7 because all book cover information has been detected and the book cover information, together with an identifier for each detected stack 7, can be called up on an internal control unit 24 and/or an external control unit 130 (see FIG. 1). The internal and the external control units 24, 130 communicate via data transmission S. To detect and select the respective identifier, a sensor is provided as a detector at the upstream end of the feeding device 10.

The feeding device 10 is provided on the driving side 9 with a side guiding device 15 which may be divided into two sections 11, 12. The sections 11, 12 are arranged successively in production direction P and are embodied to be displaceable in a direction transverse to the production direction P.

In addition, a longitudinal base 16 is arranged on the driving side 9 which is oriented parallel to the production direction P. The longitudinal base 16 is mechanically connected to one of the side guiding elements 22 on the driving side 9 of the stacking shaft 21. The side guiding element 22 and the longitudinal base 16 can be displaced transverse to the production direction P with the aid of a motor 16.3. By means of a guide 16.2 that is shown in FIG. 2 and is embodied as a spindle, as well as an additional spindle 16.1, the motor 16.3 causes displacement of the longitudinal base 16 to the stacking dimensions for a first order DS1. The segments 11, 12 that are arranged on the longitudinal base 16 move along with the longitudinal base 16 and can be adjusted accordingly for a second order DS2 and a third order DS3.

The first section 11 can be displaced transverse to the production direction P, counter to the longitudinal base 16 (FIG. 4), with the aid of a spindle 30 that is positioned rotating in the longitudinal base 16. The second section 12 can be displaced with the aid of a lifting cylinder 36 in the direction transverse to the production direction P and counter to the longitudinal base 16 (FIG. 3).

FIGS. 5A, 5B, 5C, 6A and 6B show an enlarged view of the installed spindle 30 as part of a detail of the feeding device 10. The feeding device 10 comprises a drive 32 with drive shaft 34 which is assigned to the first section 11, wherein the spindle is connected via a spindle mechanism 33 to the drive 32. The drive shaft 34 provided with a first conical gear 33.1 at its exposed end engages in a second conical gear 33.2 of the spindle drive 33, thereby causing a rotation around an axis positioned transverse to the drive 32. The second conical gear 33.2 is embodied to form one end of the spindle 30. According to FIG. 5C, the spindle 30 is the only adjusting element.

According to FIGS. 5A, 5B, 6A and 6B, the first section 11 can additionally be displaced transverse to the production direction P with the aid of a lifting cylinder 36. The spindle 30 and the lifting cylinder are connected in series via a mounting plate 18. The spindle 30 can be moved relative to the longitudinal base 16 by rotating the mounting plate 18. The lifting cylinder 36, which is arranged below the spindle 30, displaces the first section 11 relative to the mounting plate 18 (see in particular FIGS. 5A, 6A and 6B).

Figure 6A:
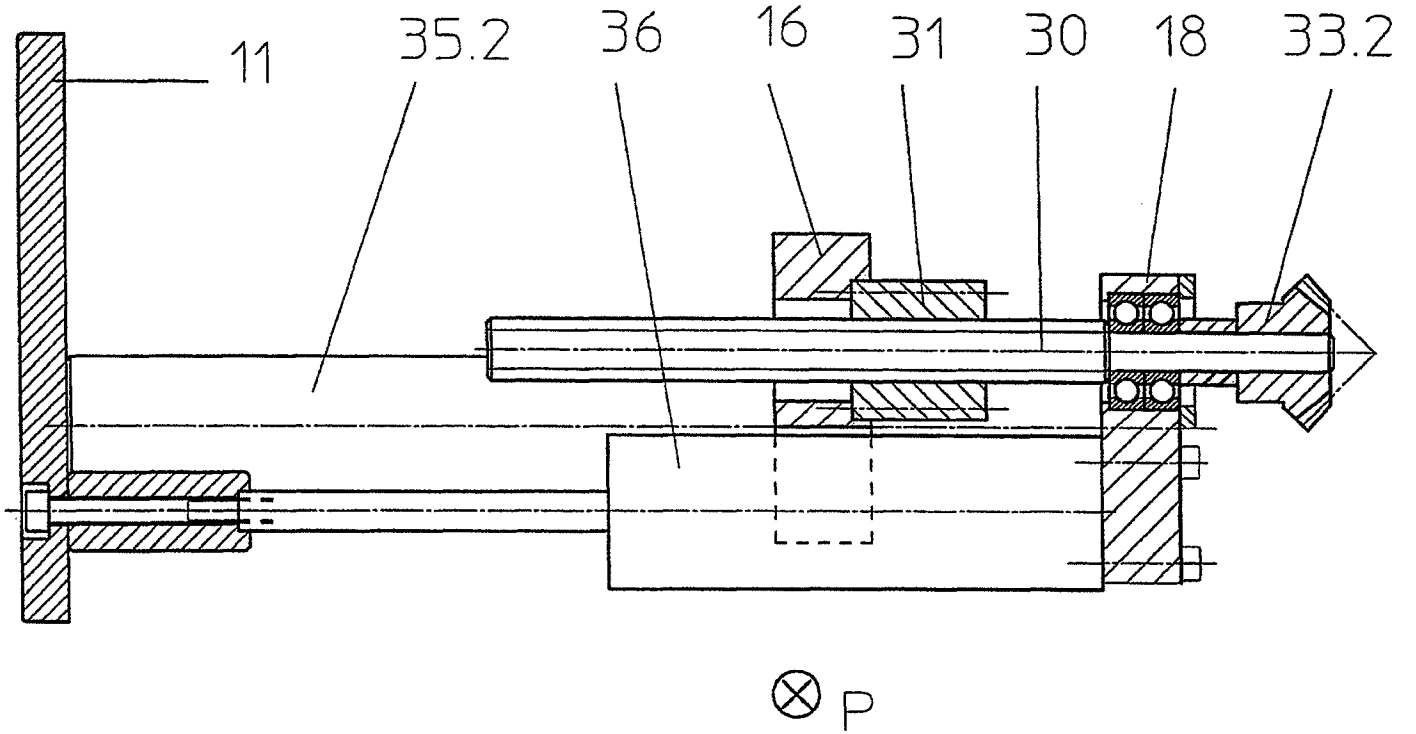
FIG. 6A—an axial section A-A through the side guiding device of the book cover feeder shown in FIG. 3, as seen in a direction transverse to the flow direction, with maximally screwed in spindle and maximally extended lifting cylinder.
Figure 6B:
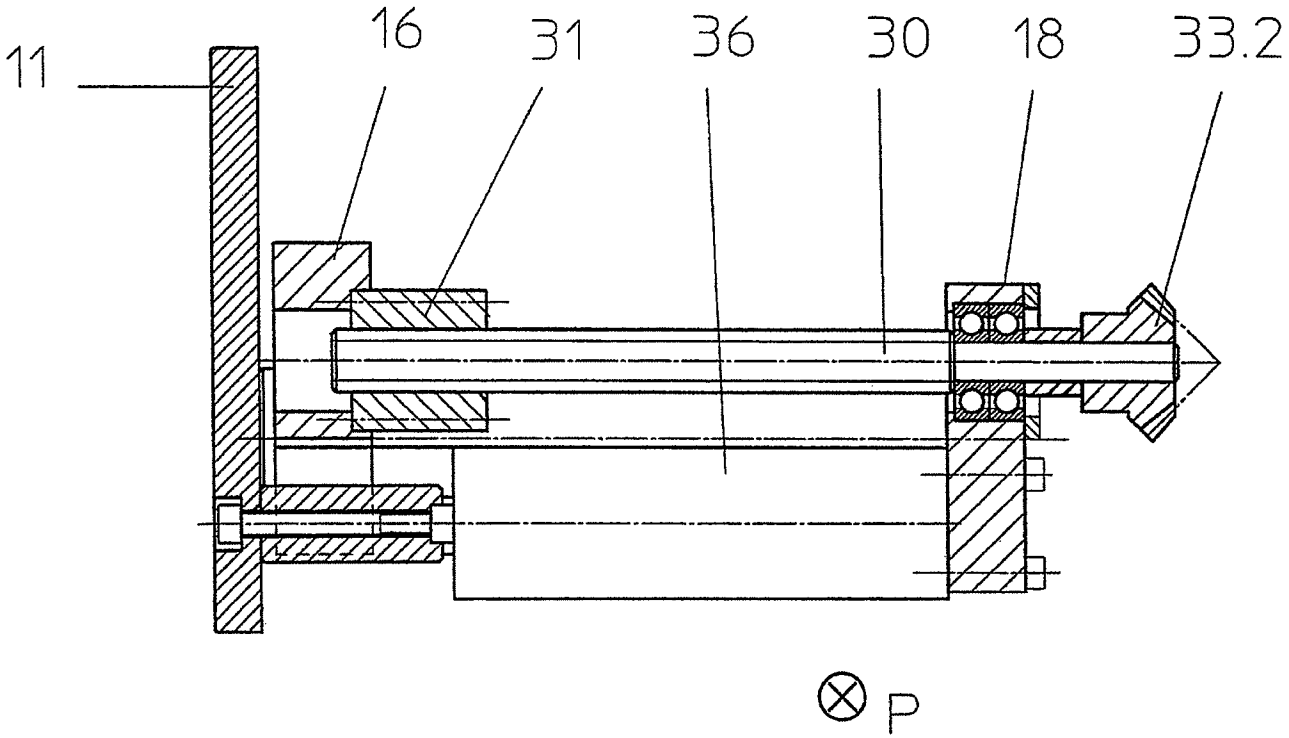

FIG. 6A shows a maximally extended section 11, wherein the lifting cylinder 36 as the advancing element is moved out completely. For the section 11 to reach this position, the spindle 30 must be screwed in completely in the direction of the drive. FIG. 6B shows the other extreme where a section 11 is moved in by the maximum amount.

The first section 11, which can be displaced transverse to the production direction P, in this case remains oriented parallel to the production direction P. This is ensured by guide elements 35.1, 35.2 which are arranged to the side of the spindle 30. The guide elements 35.1, 35.2 form a paired telescopic guide 35. A rod 37 is arranged in the center of each telescopic guide 35, wherein this rod 37 is screwed on the front to the first section 11. The rod 37 can be displaced in axial direction inside the telescopic guide 35. The cylinder 36 is used for this displacement.

The book cover feeder 1 according to FIGS. 1 to 4 comprises at least one sensor 40 for detecting and reading an identifier on an optional book cover 7.1-**7.*n* or on the stack 7. The sensor 40 is arranged at the end of the feeding device 10 which is facing away from the stacking shaft 21, as seen in the production direction P. A signal transmitter 41 is arranged downstream thereof, or at the end of the feeding device 10 that is facing the stacking shaft 21 in production direction P, which is embodied as a light barrier and functions to detect a gap L between deposited book covers 7.*n* and 7.1 (FIGS. 2 and 3**).

The sensor 40 may be in the form of a barcode reader which automatically identifies the stack 7 based on its identifier, and compares the identifier to the data specified by the external control unit 130.

The data for the stack 7 are generated ahead of time through detection and are transmitted automatically to the book production line. The subject matter of the present invention does not cover this detection of data.

Following the transfer to the feeding device 10, the barcode reader automatically checks whether the sequence of book covers 7.1 to **7.*n* in the stack 7 is maintained and compares this data to existing data. As a result of this action of using existing data, a pre-adjustment of the first section 11** is possible in case of an upcoming format change.

The buffer storage of the book cover feeder preferably comprises several hundred book covers and thus feeds the required pre-production run for the book block production.

The new book cover feeder 1, which is sequentially divided and can be re-adjusted for the respective format, permits the processing of several different stacks 7 in the book production line 6. As a result of this, the external control unit 130 can take over the comparison and control of the book blocks 3 that are provided with a barcode with the use of the sensor (barcode reader) 40 provided at the book block feeder. The external control unit 130 may be connected to the internal control unit by the data transmission S and thereby used together with the internal control unit 24 for the book production line 6. Of course, this can also be realized without the internal control unit 24, meaning only with the external control unit 130.

Depending on the configuration of the machine, 8 or 14 book blocks can also be positioned in the processing stations instead of the previously mentioned 4 book blocks. This fact urgently requires that the machine has the correct sequence of book blocks and book covers. In case of a mismatch between the book blocks and the book covers, the respective book block is conveyed out before entering the book production line. The book production line thus only contains a number of book blocks as specified and in the sequence as predetermined by the external control unit 130, relative to the book covers in the cover feeder.

As a result of these automated steps and the data transmission, a mismatch is nearly impossible. If such a mismatch nevertheless occurs, then the production is only interrupted following several matching attempts. The counter-control of the book cover takes place in the cover feeder. Two cycles prior to combining the book block and the book cover, a barcode reader compares the book cover data to the data for the available book blocks. If the data do not match, the book production line stops in a controlled action, meaning processing steps are completed and the cover transport is stopped to remove the incorrect book cover. Of the four books still in the casing-in machine, three are finished and discharged from the book production line. The fourth book block without a book cover is not provided with glue on the side and is removed from the book delivery.

Since the removed book block is not defective and only lacks a book cover, it can again be supplied during a later processing with the corresponding book cover.

It will be understood that the above description of the present invention is susceptible to various modifications, changes and adaptations, and the same are intended to be comprehended within the meaning and range of equivalents of the appended claims.

What is claimed is:

1. A book cover feeder to supply book covers to a production unit of a book production line, the feeder having a guiding side and a driving side for conveying the book covers in a production direction, the book cover feeder comprising:

a feeding device onto which book covers of a single format are deposited singly, in a scaled formation or in a stack formation;

a magazine arranged to receive the covers from the feeding device, the magazine having a stacking shaft; and a separating device operatively arranged relative to the magazine;

wherein the feeding device, the cover magazine and the separating device are embodied integrally or adjoining each other; and wherein the feeding device includes, on at least one of the guiding side and the driving side, a side guiding device that is divided into multiple sections arranged one behind the other in the production direction.

2. The book cover feeder according to claim 1, wherein at least a first section of the side guiding device, as seen in the production direction, is displaceable in a direction transverse to the production direction.

3. The book cover feeder according to claim 1, wherein the stacking shaft includes a side guiding element, and at least a last section of the side guiding device, as seen in the production direction is displaceable together with the side guiding element of the stacking shaft in a direction transverse to the production direction.

4. The book cover feeder according to claim 3, further including a longitudinal base mechanically connecting the side guiding sections of the side guiding device and the side guiding element.

5. The book cover feeder according to claim 4, further including:

a drive;

a drive mechanism coupled to the drive; and a spindle coupled to at least one of the guiding sections, and rotatably positioned in the longitudinal based and coupled to the drive via the drive mechanism, wherein the spindle is arranged to displace at least one of the multiple guiding sections, respectively, transverse to the production direction and counter to the longitudinal base.

6. The book cover feeder according to one claim 1, further including a lifting cylinder coupled to displace at least one of the guiding sections transverse to the production direction.

7. The book cover feeder according to claim 6, wherein the spindle and the lifting cylinder are connected in series.

8. The book cover feeder according to claim 2, wherein the guiding sections are oriented parallel to the production direction, and further including guide elements operatively arranged to assist displacing the guiding section transverse to the production direction while maintaining the parallel orientation of the guiding sections.

9. The book cover feeder according to claim 8, wherein the guide elements comprise a paired telescopic guide.

10. The book cover feeder according to claim 1, wherein at least one of the book covers or a stack of book covers has an identifier, and wherein the book cover feeder includes at least one sensor for detecting and reading the identifier, wherein the first sensor is arranged on an end of the feeding device which facing away from the stacking shaft, as seen in production direction.

11. The book cover feeder according to claim 1, further comprising a signal transmitter to detect a gap between deposited book covers, the signal transmitter being arranged downstream of the feeding device or at the end of the feeding device facing the stacking shaft, as seen in production direction.

12. A method for creating a stack of book covers on a book cover feeder, comprising the steps of:

identifying and reading an identifier on a detected stack;

calling up cover information relating to the detected stack;

aligning a first guiding section of the cover feeder in dependence on a format information obtained through the identifier;

depositing the detected stack of book covers onto the feeding device, against the first guiding section; and conveying the first stack in the production direction.

13. The method according to claim 12, wherein steps of identifying, call up, aligning, depositing and conveying are performed in the sequence recited.

14. The method according to claim 12, the method steps are repeated so that detected stacks are deposited sequence by sequence, one after another, onto the feeding device, resulting in a sequential, format-dependent alignment of the first section.

15. The method according to claim 12, wherein the aligning step includes displacing the first section to a desired position with the aid of a lifting cylinder and/or a spindle.

16. A method to supply book covers to a production unit of a book production line, comprising utilizing the book cover feeder according to claim 1.

17. A book production line, comprising a book cover feeder according to claim 1.

* * * * *